US008015627B2

(12) United States Patent
Baker et al.

(10) Patent No.: US 8,015,627 B2
(45) Date of Patent: Sep. 13, 2011

(54) URINARY TRANSFER SYSTEM AND ASSOCIATED METHOD OF USE

(75) Inventors: Larry R. Baker, St. Louis, MO (US); James D. Baker, legal representative, Pevely, MO (US); Warren L. Spielman, St. Louis, MO (US)

(73) Assignee: Urinary Transfer Systems Group, LLC, St. Louis, MO (US)

( * ) Notice: Subject to any disclaimer, the term of this patent is extended or adjusted under 35 U.S.C. 154(b) by 1213 days.

(21) Appl. No.: 10/526,942

(22) PCT Filed: Dec. 2, 2004
(Under 37 CFR 1.47)

(86) PCT No.: PCT/US2004/040409

§ 371 (c)(1),
(2), (4) Date: May 10, 2006

(87) PCT Pub. No.: WO2005/060558

PCT Pub. Date: Jul. 7, 2005

(65) Prior Publication Data

US 2006/0277670 A1 Dec. 14, 2006

Related U.S. Application Data

(60) Provisional application No. 60/481,785, filed on Dec. 12, 2003.

(51) Int. Cl.
*A47K 11/02* (2006.01)

(52) U.S. Cl. ..... 4/144.3; 4/144.1; 222/464.7; 604/327; 604/349

(58) Field of Classification Search ..... 4/144.1, 4/144.2, 144.3, 144.4; 604/327, 349, 350; 222/464.7

See application file for complete search history.

(56) References Cited

U.S. PATENT DOCUMENTS

| | | | | |
|---|---|---|---|---|
| 105,979 | A * | 8/1870 | Price | 4/144.1 |
| 3,114,916 | A | 12/1963 | Hadley | |
| 3,337,992 | A * | 8/1967 | Tolson | 49/29 |
| 3,727,241 | A | 4/1973 | Drouhard, Jr. et al. | |
| 3,973,479 | A * | 8/1976 | Whiteley | 454/231 |
| 4,270,231 | A | 6/1981 | Zint | |
| 4,360,933 | A * | 11/1982 | Kimura et al. | 4/301 |
| 4,631,061 | A * | 12/1986 | Martin | 604/318 |
| 4,656,675 | A * | 4/1987 | Fajnsztajn | 4/144.4 |
| 5,415,632 | A | 5/1995 | Samson | |

(Continued)

FOREIGN PATENT DOCUMENTS

GB 2129688 A 5/1984

*Primary Examiner* — Gregory Huson
*Assistant Examiner* — Janie Christiansen
(74) *Attorney, Agent, or Firm* — Husch Blackwell LLP

(57) ABSTRACT

There is a urinary transfer system and associated process that includes a urinal capable of receiving urine from a patient, urine holding container, a first conduit connected between the urinal and the urine holding container, a pump, and a second conduit connected between the urine holding container and the pump. Preferably, there is a retainer that is associated with the urinal and a removable lid associated with the urine holding container. The urinary transfer system can be powered by any type of electrical power supply and/or battery. Optimally, there is a receiver electrically connected to the pump to be able to turn the pump on and off and can preferably control the operation of the pump based on input received from a transmitter. An external male catheter can also be utilized in conjunction with the urinary transfer system.

21 Claims, 4 Drawing Sheets

U.S. PATENT DOCUMENTS 5,548,852 A 8/1996 Rowe
5,551,097 A 9/1996 Short
5,662,630 A 9/1997 Raynie
5,701,612 A * 12/1997 Daneshvar ..... 4/144.3
5,926,858 A 7/1999 Heller
5,988,705 A 11/1999 Norkey
6,000,658 A 12/1999 McCall, Jr.
6,026,519 A 2/2000 Kaluza
6,029,286 A 2/2000 Funk
6,129,699 A 10/2000 Haight et al.
6,161,228 A * 12/2000 Wietecha ..... 4/625
6,257,446 B1 * 7/2001 Pike ..... 222/52
6,309,275 B1 10/2001 Fong et al.
6,311,339 B1 11/2001 Kraus
6,805,690 B2 10/2004 Ogden et al.
6,857,137 B2 2/2005 Otto
6,904,621 B2 6/2005 Otto et al.
7,100,601 B2 * 9/2006 Bruna ..... 128/200.14
2004/0128749 A1 * 7/2004 Scott ..... 4/144.1

* cited by examiner

URINARY TRANSFER SYSTEM AND ASSOCIATED METHOD OF USE

APPLICATION CROSS-REFERENCE

This application is a national phase application under 35 U.S.C. Section 371 of International Application No. PCT/US04/040409 filed Dec. 2, 2004, which claims benefit of U.S. Provisional Patent Application No. 60/481,785, filed Dec. 12, 2003.

BACKGROUND OF THE INVENTION

Currently, a bedridden individual who cannot control his or her bladder is forced to utilize a urinal-type device. Also, such devices are utilized by people who cannot easily make a trip to a restroom. This urinal-type device will store the urine on top of the bed for extended periods of time prior to disposal. By increasing the volume of the urinal-type device, the time period for emptying the urine from the urinal-type device can be increased. However, when the size of the urinal-type device is increased, there are numerous problems that can result. This includes having a bulky and cumbersome device that is positioned on the bed itself that makes it more difficult for the person to relax or sleep in bed. Also, the larger the volume of collected urine, the greater the stench that will be produced by the collected urine. Moreover, when these urinal-type devices leak, a significant disaster can result due to the large volume of urine and the physical presence of the urinal-type device on the bed itself. This will require the patient to be temporarily moved and the entire bed will need to have the soiled linens removed and laundered. The bed will then need to be cleaned and sanitized followed by having fresh linens placed on the bed. The patient will then be moved back to his or her bed. This can be a tremendous inconvenience for the patient and if the facility is short-staffed, can result in an uncomfortable and unsanitary condition for the patient for an extended period of time. Moreover, most urinary transfer systems that are used in place of a simple portable urinal, currently on the market today require the use of a catheter or require very invasive medical procedures.

The present invention is directed to overcoming one or more of the problems set forth above.

SUMMARY OF INVENTION

In an aspect of this invention, a urinary transfer system is disclosed. This urinary transfer system includes a urinal capable of receiving and holding urine from a patient or person, a urine holding container, a first conduit connected in fluid flow relationship between the urinal and the urine holding container, a pump, and a second conduit connected in gas flow relationship between the urine holding container and the pump, wherein the urine is drawn from the urinal into the urine holding container by operation of the pump but not into the pump. Therefore, throughout this application, the fluid in the first conduit is liquid while the fluid in the second fluid flow conduit is gas.

In another aspect of this invention, a urinary transfer system is disclosed. This urinary transfer system further includes a retainer such as a weight or a channel member that is removedly associated with the urinal. Optimally, the weight can be removedly attached to the urinal through the use of VELCRO®.

In yet another aspect of this invention, a urinary transfer system is disclosed. The urinary transfer system includes a removable lid associated with the urine holding container for disposing of urine from the urine holding container and sealing the container during use.

In still another aspect of this invention, a urinary transfer system is disclosed. The urinary transfer system includes a first electrical connector connected to the pump. The first electrical connector is capable of providing power to the pump drive. Throughout this patent application any type of electrical power supply will suffice including those providing both alternating and direct current and any combination thereof. In the alternative, the first electrical connector is capable of providing power from a battery to the pump drive. All types of batteries will suffice including dry, wet, gel, rechargeable, and so forth.

In another aspect of this invention, a urinary transfer system is disclosed. The urinary transfer system includes a receiver electrically connected to the pump drive to be able to turn the pump drive on and off. Preferably, the receiver can control the operation of the pump based on input received from a transmitter.

In yet another aspect of this invention, a process for transferring urine is disclosed. This process includes receiving urine from a patient into a urinal, applying a suction (negative pressure) on a urine holding container through a pump connected to the urine holding container through a second conduit, and drawing the urine from the urinal through a first conduit into the urine holding container due to the suction created in the container by the pump via the second conduit.

In yet another aspect of this invention, a process for transferring urine is disclosed. This process includes attaching a retainer to the urinal. In another aspect of this invention, a process for transferring urine is disclosed. The process includes utilizing a removable lid with the urine holding container for disposing of urine from the urine holding container.

Yet another aspect of this invention is a process for transferring urine is disclosed. The process includes attaching a first electrical connector connected to the pump drive. A first process includes applying alternating power to the pump. Throughout this patent application any type of electrical power supply will suffice including those providing both alternating and direct current and any combination thereof. In the alternative, the first electrical connector is capable of providing power from a battery to the pump drive. All types of batteries will suffice including dry, wet, gel, rechargeable, and so forth.

Still another aspect of this invention, a process for transferring urine is disclosed. The process includes transmitting commands to operate the pump drive from a transmitter to a receiver that is electrically connected to the pump drive to be able to turn the pump drive on and off. Preferably, selective operation of the transmitter will provide input signals to the receiver to control the operation of the pump.

These are merely some of the many aspects of the present invention and should not be deemed an all-inclusive listing of the many aspects associated with the present invention. These and other aspects will become apparent to those skilled in the art in light of the following disclosure, claims and accompanying drawings.

BRIEF DESCRIPTION OF DRAWINGS

For a better understanding of the present invention, reference may be made to the accompanying drawings in which.

DETAILED DESCRIPTION OF THE INVENTION

In the following detailed description, numerous specific details are set forth in order to provide a thorough understanding of the invention. However, it will be understood by those skilled in the art that the present invention may be practiced without the specific details. In other instances, well known methods, procedures and components have not been described in detail so as to obscure the present invention.

Figure 1:
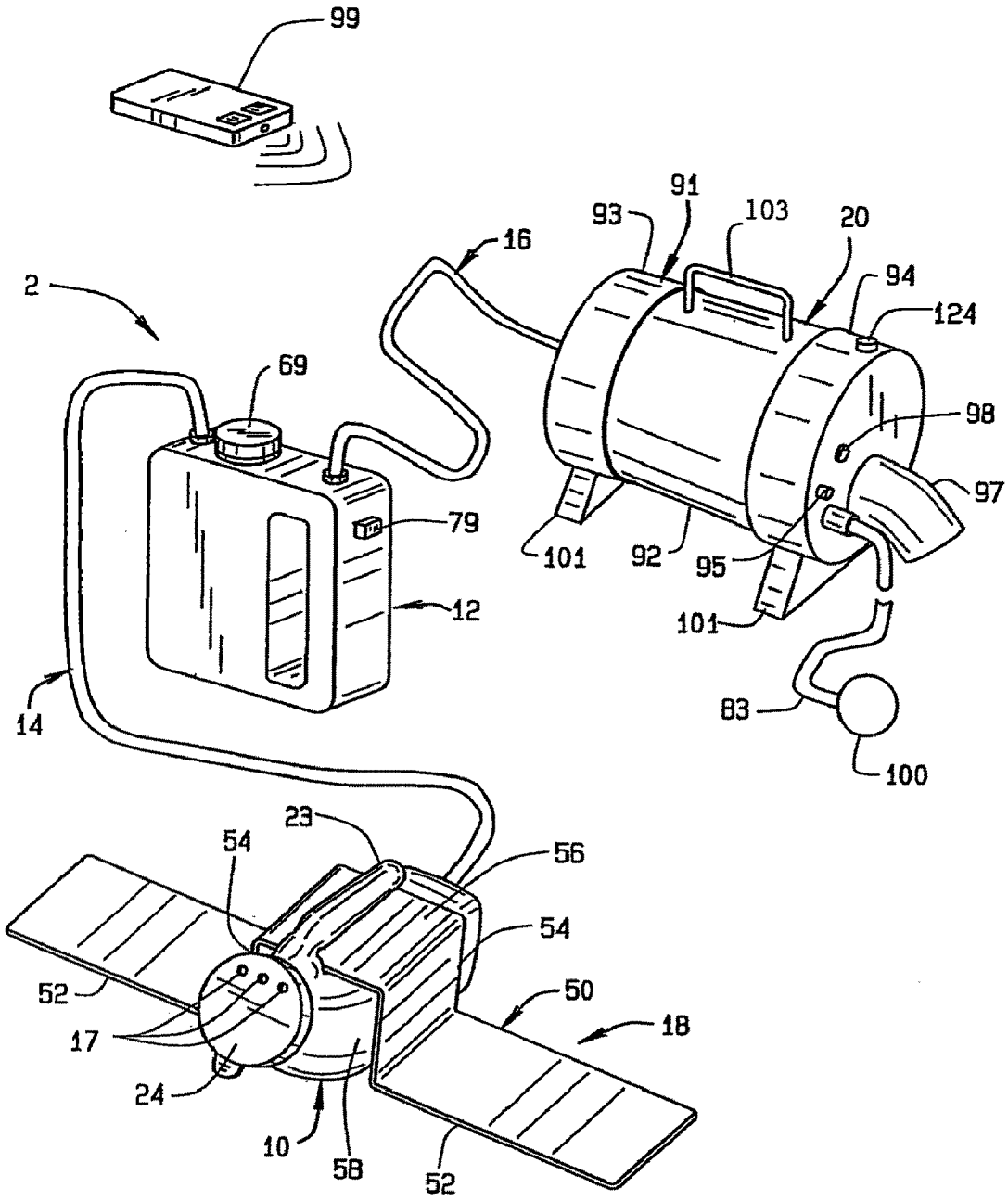
FIG. 1 is a perspective view of a urinary transfer system illustrating the connections between a urinal portion, a urine holding container portion, and a pump device.
Figure 3:
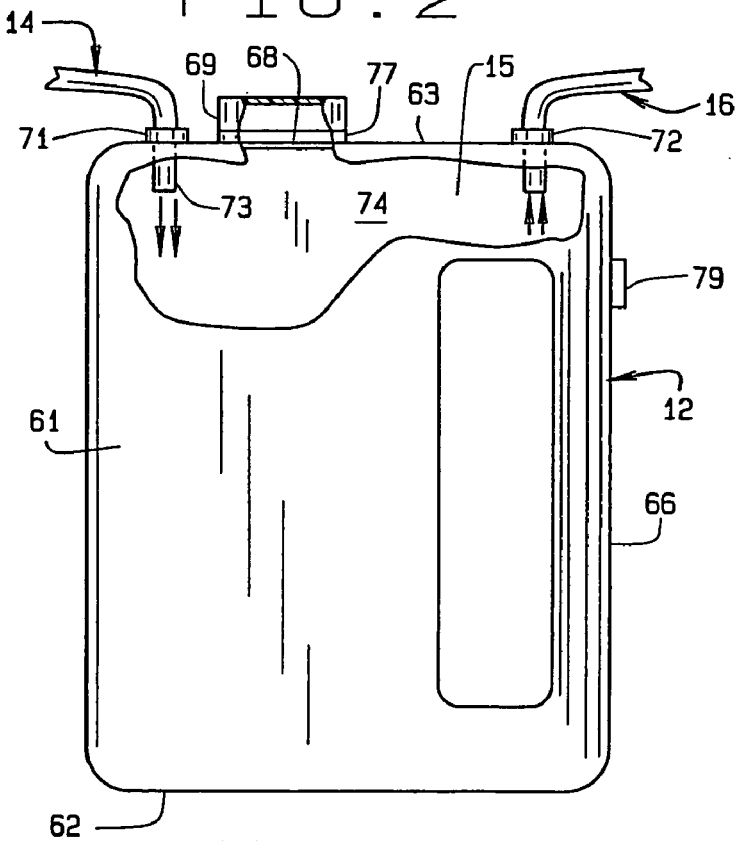
FIG. 3 is an enlarged partial fragmentary view of the urine holding container.

Referring now to FIG. 1, the urinary transfer system of the present invention is generally designated by the numeral 2. The urinary transfer system 2 comprises a plurality of major components. Those components include a urine collector or urinal 10, connected in liquid flow communication to a holding or collection container 12 by a first conduit 14. The container 12 is connected in gas flow communication to a pump device 20 via a second conduit 16. The container 12 has a liquid collection and storage reservoir 15, as shown in FIG. 3. Referring again to FIG. 1, a means 18 may be provided for fixing or retaining the urinal 10 in positional relationship relative to a person for its use. The means 18 is preferably adapted for holding the urinal 10 in fixed positional relationship to a patient, bed or the like, the bed and user not being shown.

Figure 2:
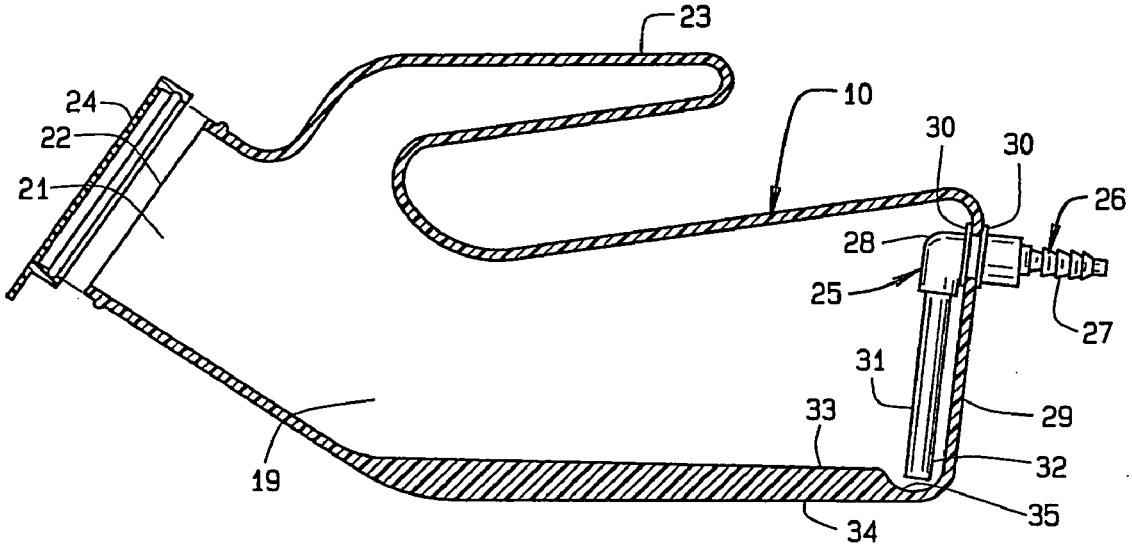
FIG. 2 is an enlarged partial fragmentary view of the urinal portion.

Preferably, the urinal 10 is custom designed based on ergonomic considerations for receiving urine from a patient. The urinary transfer system 2 may be used by any person and may be used in a supine position, sitting position or standing position by the patient or user. In a preferred embodiment, both in construction and use, the urinal is primarily directed to male patients but by proper design of the entry of the urinal 10, as hereinafter described, the urinal may also be used by females. The present invention is particularly well adapted for use by any bedridden individual who cannot control his or her bladder and is forced to utilize a urinal type device. The urinary transfer system 2 may also be used by a patient or person who has difficulty in moving to a restroom. The present invention is particularly applicable for use in hospitals, nursing homes, extended care facilities and/or in-home care. The urinal 10, as shown in FIG. 2, includes a first collection chamber or reservoir 19 sized in volume to contain an amount of urine encountered in one patient relief. Preferably the first collection chamber or reservoir 19 has a volume capable of storing at least about 8 ounces (0.237 liters) of liquid. The urinal 10 includes a portal or entry 21 with an opening 22 adapted for surrounding and communicating with a portion of the urethra of either a male or female. Therefore, this patent application is equally applicable to both men and woman. The opening 22 may be closed, at least partially with a snap lid 24. The urinary transfer system 2 may be provided with a vent to prevent the application of excessive negative pressure. As shown in FIG. 1, the lid 24 can be provided with one or more vent holes 17. The vent hole(s) 17 may instead be provided in an upper wall portion or the handle 23 of the urinal 10 among other locations.

The urinal 10 may be provided with the handle 23 to facilitate moving the urinal and transporting the urinal. As best seen in FIG. 2, the urinal 10 further includes a liquid pickup device 25 which is adapted for facilitating removal of urine from the urinal for transfer through the first conduit 14 to the reservoir 15 of container 12. As seen, the pickup 25 includes a device 26 for connecting to the first conduit 14. As an illustrative example only, a hose barb 27 of the male type may be provided and adapted for being received and sealed within the first conduit 14, for example, a flexible plastic tubing which can be polyethylene, nylon, vinyl or the like. The hose barb 27 is mounted to the urinal 10 through a street ell 28 through appropriate fittings. The hose barb 27 and the street ell 28 may be secured to an end wall 29 of the urinal 10 and sealed thereto. To reinforce the connection, washers 30 may be provided on both sides of the end wall 29 with the washers being of a rigid polymeric or other non-corrosive material, for example, stainless steel. As an alternative throughout this patent application, quick disconnect fittings, which are more convenient as well as typically more expensive, can also be utilized instead of hose barbs 27. An illustrative, but nonlimiting, example of quick disconnect coupling is disclosed in U.S. Pat. No. 5,988,705 that issued to Phillip Norkey and was assigned to Pilot Industries, Inc. on Nov. 23, 1999, which is incorporated herein by reference.

A siphon tube 31 is secured to the street ell 28 as for example by being threaded together preferably using a pipe thread to provide a sealed connection. Preferably the siphon tube 31 is rigid to retain its open end 32 adjacent the bottom of the first collection chamber or reservoir 19 of the urinal 10. Preferably, the open end 32 of the siphon tube 31 is positioned close to but spaced from the lower inside surface 33 of the bottom wall 34 forming the first collection chamber or reservoir 19, for example, $1/16^{th}$ of an inch (0.0625 inches) (0.15875 centimeters). The components of the pickup device 25 may be a non-corrosive plastic, metal or metal alloy. A recess or well 35 may be provided in the bottom wall 34 to enhance liquid pickup by having the open end 32 positioned therein. An important advantage of the siphon tube 31 is that in the event of an accidental or inadvertent disconnection of the first conduit 14 from the hose barb 27 will not result in a copious discharge of urine on the bed or elsewhere. This eliminates the need for a costly valve between the first conduit 14 from the hose barb 27 to prevent potential spillage problems.

The first conduit 14 may include a flexible tube such as a plastic tube, for example, polyethylene, nylon, vinyl or the like and preferably is transparent or translucent which allows for visually checking for correct operation of the transfer system 2. The second conduit means 16, described below can be of the same general construction as the first conduit 14. The length of the first and second conduits 14, 16 can be any suitable length and it is preferred that the inside diameter be about ¼ inch (0.25 inches) (0.635 centimeters) or the like.

Figure 5:
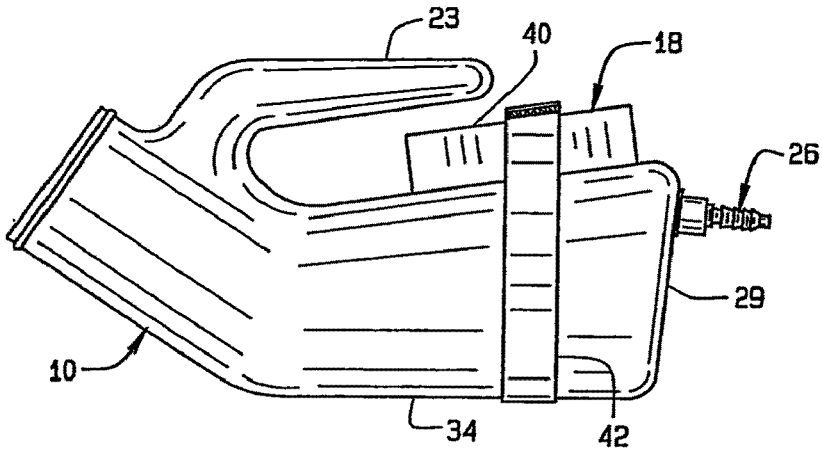
FIG. 5 is an enlarged perspective view of an alternate retaining device.

The means 18 includes a securement device which may be provided for fixing the urinal in position relative to the user. Positional fixing is preferably on a temporary basis but may be on a semi-permanent or permanent basis depending on the condition of the user. For example, a coma patient may need a permanent fixing of the urinal 10 in the appropriate position, while a person recovering from minor surgery needs only a temporary fixing in position, if any at all. Preferably, but not necessarily, the urinal 10 includes at least one detachable weight 40, as shown in FIG. 5, that fixes the urinal 10 in position in relationship to a patient or person. A wide variety of attachment mechanisms 42 can be utilized to removably attach a weight 40 to the urinal. However, the preferred attachment mechanism includes the use of a hook and loop fastener such as those branded VELCRO®. The weight 40 may be secured to the top of the urinal but preferably to the bottom to lower the center of gravity. VELCRO® is a federally registered trademark of Velcro Industries B.V. which is a limited liability company located in the Netherlands, having a place of business at Castorweg 22-24 Curacal, Netherlands Antilles. Therefore, the weight 40 will be either encased in VELCRO® or at a minimum have at least one strip positioned and secured thereon. In the same manner, the attachment mechanism 42 will include at least one strip of VELCRO® that is fixably attached to the urinal 10. The preferred way to secure the attachment mechanism 42 to the urinal 10 is through adhesives, however, a wide variety of methods for securing the attachment mechanism 42 to the urinal 10 will suffice. This will operate to secure the weight 40 to the urinal 10 by placing the weight against the attachment mechanism 32. A modified form of attachment device is seen in FIG. 1.

FIG. 1 shows an alternative embodiment of fixing means 18. This embodiment includes a device 50 which, as shown, is referred to as a hat section. It includes a pair of oppositely extending wings 52 to which are connected and extending upwardly therefrom two legs 54 which are connected by an intermediate bight section 56. The device 50 may be made of a metal alloy or plastic. The size and shape of the channel 58 formed between the legs 54 and the bight section 56 is such as to receive therein a portion of the reservoir portion of the urinal 10 device. The bight section 56 and extending wings 52 hold the urinal 10 down while the legs 54 prevent lateral movement of the urinal 10. The extending wings 52 may be placed under the legs of a patient or user when they are in a supine (lying on the back) or sitting position affixing the urinal 10 in position relative to the patient or user.

Referring now to FIG. 3, the container 12 can be of any suitable form, size, shape and volume but preferably is on the order of one (1) to five (5) gallons (3.79 to 18.9 liters) in storage capacity. The container 12 may be made of any suitable material and is preferably made of a polymeric (plastic) material that may be easily sanitized or inexpensive enough to be disposable. Such material can be polyethylene, polypropylene, polyvinyl chloride, etc. Polymeric material is preferable to glass because of its break resistance and weight. Metal and metal alloys may also be used. The container 12 includes a side wall 61, bottom wall 62 and top wall 63. The container 12 is preferably provided with a handle 66 or a pair of handles for lifting and helping tilt the container when it is desired to pour out the contents. A handle 66 may be provided on the top wall 63, bottom wall 62 and preferably on the side wall 61 of the container 12, as desired. A closable opening 68 may be provided and selectively closed with a removable lid 69. The first and second conduits 14, 16 are each connected to a respective connector 71, 72. As an alternative throughout this patent application, quick disconnect fittings, which are more convenient as well as typically more expensive, can also be utilized. Preferably, the connector 71 points downwardly and has an open end 73 that terminates close to the top wall 63 of the container 12.

When liquid is drawn into the container 12 through the application of negative pressure in the head space 74 of the container 12, it is preferred that the incoming liquid be downwardly directed. The outlet connector 72 is adapted to be connected in flow communication to the pump device 20 which will induce a negative pressure in a second conduit 16 and hence the head space 74, conduit 14, reservoirs 15, 19 and pickup 25. The connector 72 is also preferably generally downwardly directed or in a direction to help eliminate the transfer of any incoming liquid or contained liquid from entering the connector 72 and hence the second conduit 16. The opening 68 may be in a dispensing spout 77 and be in a position for proper use and manipulation with the handle 66. The dispensing spout 77 may be provided with the lid closure 69 to help achieve a negative pressure in the container, i.e., a pressure below that of the surrounding atmosphere external of the container 12. A sensor 79, e.g., level sensor, may be provided to provide an alarm or other signal that can alert a helper that the container 12 needs to be emptied. The sensor 79 may also be used to prevent operation of the pump device 20 should the container 12 become full or out of its normal upright position, e.g., tilted or turned over.

Figure 4:
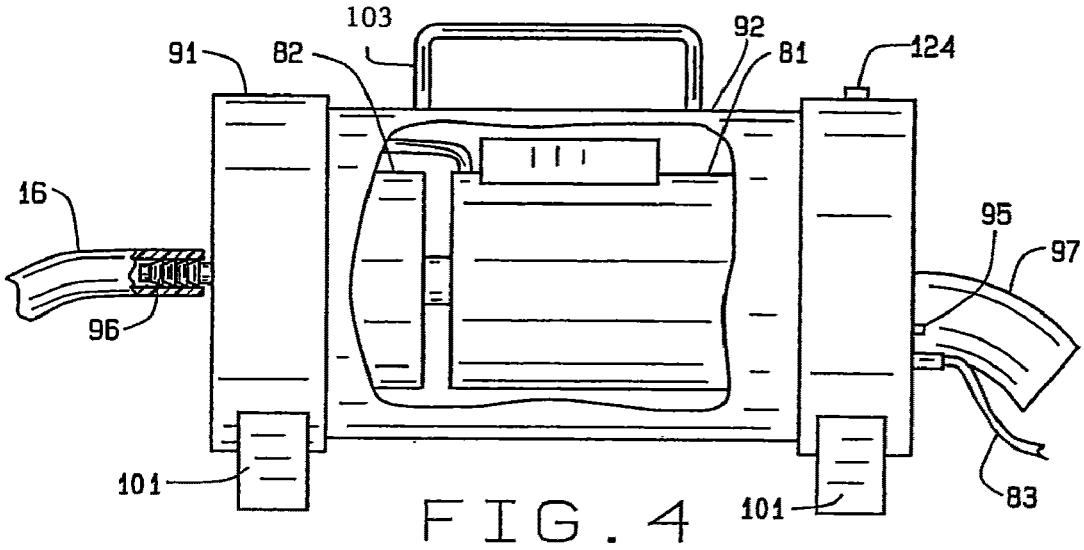
FIG. 4 is a partial fragmentary view of the pump device and housing.

The pump device 20 includes a pump 81 and a drive device such as an electric motor 82, as shown in FIG. 4. The electric motor 82 may be either powered by alternating current or direct current and may be battery operated if desired via a power source connection 83. As previously stated, any type of electrical power supply will suffice including those providing both alternating and direct current and any combination thereof. In the alternative, the first electrical connector is capable of providing power from a battery to the pump drive. All types of batteries will suffice including dry, wet, gel, rechargeable, and so forth. A combination of power sources may be used if desired. Any suitable pump 81 may be utilized so long as it is capable of providing a sufficient negative pressure in the head space 74 of the container 12 to remove urine from the first collection chamber or reservoir 19 of the urinal 10 and transfer it to the container 12 through the conduit 14. A suitable pump 81 may be a vane-type pump or other suitable pump capable of pumping a gas such as air. Such pumps are well known in the art. There only needs to be enough negative pressure in the head space 74 that is adequate to affect the transfer while still retaining the structural integrity of the container 12 as well as not pinching off the first and second conduits 14, 16.

The pump device 20 is preferably housed within a housing 91 to provide protection thereto and to provide aesthetic appeal. Preferably the housing 91 is made of a cylindrical member 92 such as a section of PVC or metal tube having two end caps 93, 94 such as PVC pipe end caps. However, a full spectrum of geometric shapes and sizes may suffice for the components of the housing 91 and associated support. The pump device 20 is preferably sealed to prevent the creation of sparks that could create problems in environments where oxygen is administered. One end cap 93 can be provided with some or all of the connections, for example, the conduit connector 96 for the second conduit 16. The other end cap 94 may be provided with other components such as a sensor or antenna element 98 for receiving signals from a remote control device 99 described below, power connector 83, power overload protector, e.g., fuse or circuit breaker 95, and a pump exhaust 97. The sensor or antenna element 98 is preferably housed within the other end cap 94.

A plurality of arcuate feet 101, preferably at least two, may be provided and attached to the housing 91 to provide resistance to rolling of the cylindrical housing. A handle 103 may also be provided to facilitate lifting and carrying.

Figure 6:
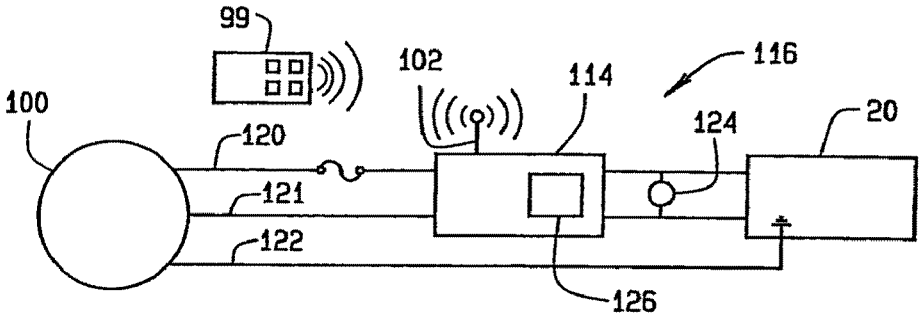
FIG. 6 is a schematic illustration of an operating control system.

The pump device 20 applies a negative pressure, commonly called a vacuum, to the urine holding container 12 via the second conduit 16 as described above. The negative pressure induced by the pump 81 of the pump device 20 draws urine from the first collection chamber or reservoir 19 of urinal 10 into the reservoir 15 of the urinal holding container 12 through the first conduit 14 and through the siphon tube 31 of the pickup 25. Referring now to FIG. 6, the motor 82 is connected to a power source 100 via a first electric connector indicated by numeral 83. The power source 100 can be either a battery, a conventional alternating current power supply, a portable generator or the like, or a combination of sources. A non-limiting example of a pump device 20 includes that disclosed in U.S. Pat. No. 5,415,632 issued May 16, 1995 to Ilan Samson and assigned to Playskol, Inc., which disclosure is incorporated herein by reference. Another non-limiting example includes the pump device disclosed in U.S. Pat. No. 6,129,699 issued on Oct. 10, 2000 to Levoy G. Haight et al. and assigned to Sorenson Development, Inc. which disclosure is incorporated herein by reference.

Preferably the motor 82 and hence the pump 81 can be turned on or off through a control system 116. The control system 116 is preferably wireless and includes the remote controller 99 such as a wireless transmitter, receiver element 102 and a receiving controller 114. The signal from the remote controller 99 is picked up by receiver element 102 that is electrically connected to the pump motor 82. The signal from the remote controller 99 may be a light signal or a radio signal. Preferably, the remote controller 99 and receiver element 102 along with the components in the receiver controller 114 can also be used to control the speed and hence the negative pressure as well as all other operating parameters of the pump device 20. A wide variety of remote controllers 99 and receiver elements 102 may suffice with the present invention. A non-limiting example includes that disclosed in U.S. Pat. No. 6,309,275 issued on Oct. 30, 2001 to Peter Sui Lun Fong et al., which disclosure is incorporated herein by reference.

FIG. 6 illustrates the control system 116 and its elements. As seen, a control device or remote controller 99 is provided along with a compatible receiver element 102. The receiver element 102 is connected to the power source 100, for example, a 110 volt AC circuit via hot, neutral and ground lines 120, 121, 122 respectively. An indicator light 124 may be provided to show that the pump device 20 has been activated. The controller 114 is connected to the motor 82 of the pump device 20 and is operable for turning the motor 82 on and off as commanded by a signal sent by the remote controller 99. The user of the device or patient may command the pump 81 to be operated by the motor 82 which will then create a transfer of the urine from the urinal 10 to the container 12. After the removal has been accomplished, the patient or user may through the remote controller 99 turn the pump motor 82 off. However, if the patient fails to turn the pump motor 82 off, the receiver controller 114 may be provided with a suitable timer circuit 126 which after a given amount of time will turn the pump motor 82 off.

The present invention is better understood by description of the operation thereof. A person (not shown) discharges urine into the first collection chamber or reservoir 19 and is collected therein. After or during collection, the user may activate the pump device 20 as described above. The urine collected in the first collection chamber or reservoir 19 moves initially through the siphon tube 31 of the pick-up device 25 and into the conduit 14. The pump device 20 is operated for a time period sufficient to empty the first collection chamber or reservoir 19 and for the urine to flow into the reservoir 15 of the container 12. When the urine flows into the reservoir 15, it is directed in a direction away from, i.e., not toward, the outlet connector 72. The pump device 20 may be deactivated through use of the remote controller 99 and receiving controller 114 of the control system 110. With the pump 81 operating, a negative pressure is applied to the head space 74 of the reservoir 15, the interiors of the conduits 14, 16 and the pickup device 25. The urine flows from the urinal 10 to the container 12 but not to the conduit 16.

After the urine has been extracted from the first collection chamber or reservoir 19, the pump device 20 may be deactivated either by use of the remote controller 99 or the timer 126. When urine flows from the first collection chamber or reservoir 19 through the pickup device 25 prior to being transferred to the first conduit 14. Because the urinal 10 has a first collection chamber or reservoir 19, a substantial amount of urine may be collected therein prior to the need to operate the pump device 20. When the reservoir 15 of the container 12 has reached an appropriate level, the container 12 may be disconnected from the conduits 14, 16 and taken to a disposal location. The container 12, after emptying, may be sanitized and reused depending upon the circumstances.

Figure 7:
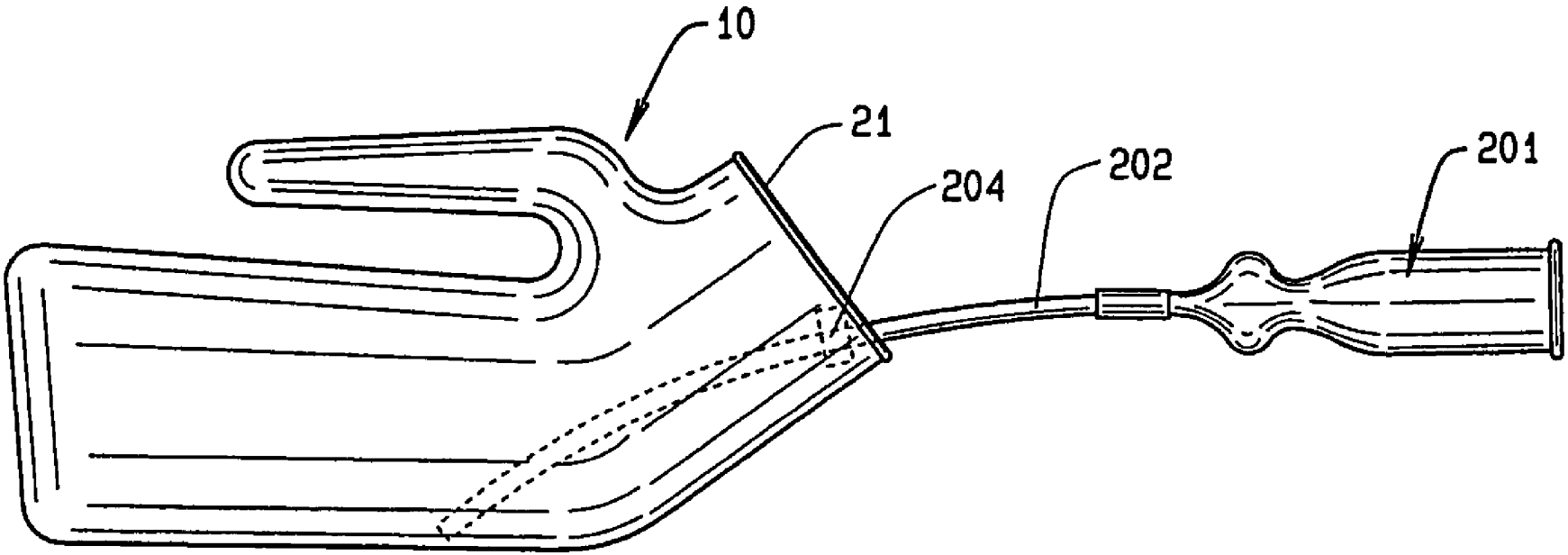
FIG. 7 is an enlarged perspective view of the urinal shown in FIG. 1 utilized with an external male catheter.

In the event it is not feasible for a male patient to use the urinal 10 directly, an external catheter 201 may be utilized as shown in FIG. 7. There are a wide variety of styles, shapes and configurations of external male catheters 201 that may be employed. An illustrative, but nonlimiting example, includes U.S. Pat. No. 6,805,690 that was assigned to the Mentor Corporation and issued on Oct. 19, 2004, which is incorporated herein by reference. The use of an external male catheter 201 is preferred over an internal catheter in order to avoid invasive medical procedures. These invasive medical procedures can create the risk of damage to body members, bleeding, infections, and so forth. This is in addition to any discomfort an invasive procedure would entail. The end of the external male catheter 201, which typically includes an outlet tube 202, would be positioned directly into the urinal 10. In the alternative, a clip or other attachment device 204 can be utilized to attach the end of the external male catheter 201 to the portal or entry 21 to the urinal 10 so that it does not slip out during operation. The urinary transfer system 2 can be operated as previously described above.

In the alternative, the outlet tube 202 of the external male catheter 201 may be utilized as the first conduit 14 with the elimination of the urinal 10 so that liquid goes from the external male catheter 201 to the holding or collection chamber 12. The vacuum created in the holding or collection chamber 12 will draw the liquid from the external male catheter 201 upon activation of the pump device 20. The vacuum of the pump device 20 may need to be reduced to obtain satisfactory and comfortable operation for the patient.

Although the preferred embodiment of the present invention and the method of using the same has been described in the foregoing specification with considerable details, it is to be understood that modifications may be made to the invention and modified forms of the present invention done by others skilled in the art to which the invention pertains will be considered infringements of this invention when those modified forms fall within the claim scope of this invention.

The invention claimed is:

1. A urinary collection system comprising:

a urinal with a first liquid storage reservoir sized in volume to receive and store at least an amount of urine encountered in at least one patient relief, said urinal having an end wall, a bottom wall and an inlet opening said end wall being substantially vertical relative to said bottom wall;

a pickup device positioned and located opposite the inlet opening of said urinal, said pickup device including a member having an inlet portion positioned in the first liquid storage reservoir said inlet portion having an axis running therethrough, and an outlet portion sealably mounted to an upper portion of the end wall of the urinal said outlet portion having an axis running therethrough and perpendicular to said inlet portion axis, the outlet portion of said member being positioned above the inlet portion, the inlet portion of said member having a siphon tube associated therewith positioned in the first liquid storage reservoir parallel to but spaced from the end wall of said urinal, said siphon tube being straight in length and perpendicular to the outlet portion, said siphon tube having an end portion positioned adjacent to but spaced from both the bottom wall and the end wall of said urinal, the pickup device forming a fluid flow path between the first liquid storage reservoir and the outlet portion;

a quick disconnect fitting associated with the outlet portion of said pickup member and connected in liquid relationship to said siphon tube;

a collection container having a second liquid storage reservoir, said collection container having a top wall, an inlet connector and an outlet connector, said inlet connector having an end portion which terminates adjacent to the top wall of the collection container and is directed downward to prevent liquid entering the second liquid storage reservoir from entering the container outlet connector:

a first conduit connecting the first storage reservoir in flow communication with the second liquid storage reservoir, said first conduit having one end portion connected to said quick disconnect fitting and having its opposite end portion operably connected to the collection container inlet connector;

a pump device comprising a pump and a drive device operable to drive the pump, said pump having an inlet and an outlet;

a second conduit connecting the second liquid storage reservoir to the pump inlet, the pump being operable to apply a reduced pressure to the first and second conduits, the pickup device and the second liquid storage reservoir to induce flow of fluid from the first liquid storage reservoir into the second liquid storage reservoir; and a control device operably associated with the pump device and operable by a user of the urinal for selectively activating and deactivating the drive device, said urinal having sufficient volume to avoid activation of said drive device during at least one complete patient relief.

2. The urinary collection system as set forth in claim 1, wherein the control device includes a wireless transmitter and a receiver, said receiver being operably connected to said drive device.

3. The urinary collection system as set forth in claim 1, wherein the control device includes a timer operable after a predetermined time to deactivate said drive device.

4. The urinary collection system as set forth in claim 1, wherein the drive device includes an electric motor.

5. The urinary collection system as set forth in claim 1, wherein the collection container includes a sensor that provides input as to when the collection container requires emptying.

6. The urinary collection system as set forth in claim 5 wherein said sensor functions to prevent operation of said drive device when the collection container is full.

7. The urinary collection system as set forth in claim 6 wherein said sensor functions to prevent operation of said drive device when the collection container is out of its normal upright position.

8. The urinary collection system as set forth in claim 1, wherein the collection container includes a closable opening with a removable lid.

9. The urinary collection system as set forth in claim 1, wherein the collection container includes a handle.

10. The urinary collection system as set forth in claim 1, wherein the urinal includes a handle.

11. The urinary collection system as set forth in claim 1, wherein the urinal includes a closable lid.

12. The urinary collection system as set forth in claim 11, wherein the closable lid includes a plurality of vent holes.

13. The urinary collection system as set forth in claim 1, wherein the first reservoir includes an indented well portion located adjacent said end wall and wherein said siphon tube is rigid, the end portion of said siphon tube being positioned within said well portion.

14. The urinary collection system as set forth in claim 1 and further including a retainer operatively associated with the urinal for selectively fixing the urinal in position relative to a user.

15. The urinary collection system as set forth in claim 14, wherein the retainer includes a weight and a strip of hook and loop fasteners.

16. The urinary collection system as set forth in Claim 14 wherein the retainer includes a hold down including a generally U-shaped member forming a channel for receiving the urinal therein and a hold down member connected to the U-shaped member and projecting outwardly therefrom and adapted to be placed under a user's leg.

17. The urinary collection system as set forth in claim 1, wherein the pump device includes a housing having a first end cap and a second end cap.

18. The urinary collection system as set forth in claim 17, wherein the housing is cylindrical and is supported by a plurality of arcuate feet.

19. The urinary collection system as set forth in claim 17, wherein the pump device includes a light indicator which illuminates when the pump device is activated and a power overload protector.

20. The urinary collection system as set forth in claim 1, further comprising an external male catheter having an outlet tube, wherein the outlet tube of the external male catheter is in flow communication with the urinal.

21. The urinary collection system as set forth in claim 20, further comprising an attachment device for securing the outlet tube for the external male catheter to the urinal so that the external male catheter is in flow communication with the urinal.

* * * * *